US007712871B2

(12) United States Patent
Drake et al.

(10) Patent No.: US 7,712,871 B2
(45) Date of Patent: May 11, 2010

(54) METHOD, APPARATUS AND PRINTHEAD FOR CONTINUOUS MEMS INK JETS

(75) Inventors: Donald Drake, Rochester, NY (US); Joseph DeGroot, Chili, NY (US); Andrew Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 490 days.

(21) Appl. No.: 11/735,093

(22) Filed: Apr. 13, 2007

(65) Prior Publication Data

US 2008/0252693 A1 Oct. 16, 2008

(51) Int. Cl.
*B41J 2/04* (2006.01)

(52) U.S. Cl. ..... 347/54

(58) Field of Classification Search ..... 347/54, 347/73–75

See application file for complete search history.

(56) References Cited

U.S. PATENT DOCUMENTS 4,638,328 A 1/1987 Drake et al.
6,981,760 B2 * 1/2006 Yamamoto ..... 347/75
7,249,830 B2 * 7/2007 Hawkins et al. ..... 347/78

* cited by examiner

*Primary Examiner*—An H Do
(74) *Attorney, Agent, or Firm*—MH2 Technology Law Group LLP

(57) ABSTRACT

An embodiment relates generally to a method of ejecting ink. The method includes providing a continuous stream of ink from a pressurized fluid chamber and activating a drive signal to activate a micro-electrostatic mechanical system (MEMS) membrane. The method also includes stably breaking up the jet stream into uniform droplets in response to deflecting the MEMS membrane to perturb the continuous stream of ink.

15 Claims, 2 Drawing Sheets

METHOD, APPARATUS AND PRINTHEAD FOR CONTINUOUS MEMS INK JETS

FIELD

This invention relates generally to continuous ink jets, more particularly, to a method, apparatus and printhead for continuous MEMS ink jets.

DESCRIPTION OF THE RELATED ART

Ink jet printing systems are usually divided into two basic types, continuous stream and drop-on-demand. In continuous stream ink jet printing systems, ink is emitted in a continuous stream under pressure through one or more orifices or nozzles. The stream is perturbated, so that it is broken into droplets at a predetermined fixed distance from the nozzles. At the break up point, the droplets are charged in accordance with varying magnitudes of voltages representative of digitized data signals. The charged droplets are propelled through a fixed electrostatic field which adjusts or deflects the trajectory of each droplet in order to direct it to a specific location on a recording medium, such as paper, or to a gutter for collection and recirculation.

In drop-on-demand ink jet printing systems, a droplet is expelled from a nozzle directly to the recording medium along a substantially straight trajectory, that is, substantially perpendicular to the recording medium. The droplet expulsion is in response to digital information signals and a droplet is not expelled unless it is to be placed on the recording medium. Except for periodic, concurrent expulsion of droplets from all nozzles into a receptacle to keep the ink menisci in the nozzles from drying, drop-on-demand systems require no ink recovering gutter to collect and re-circulate the ink and no charging or deflection electrodes to guide the droplets to specific pixel locations on the recording medium. Thus, drop-on-demand systems are much simpler than the continuous stream type. However, continuous stream systems typically have much higher productivity.

Generally, the ink in a continuous stream type ink jet printer is perturbated or stimulated by a piezoelectric device attached to the printhead so that regular pressure variations are imparted to the ink in the printhead manifold. The piezoelectric device is usually driven at a frequency in the range of 100 to 125 kHz. It is also known that the ink perturbations can be accomplished by electro-hydrodynamic electrodes positioned at the printhead orifices and certain forms of thermal energy pulses.

One issue with thermal energy pulses is that power is dissipated by each ink channel on each break-off cycle. Since a full cycle can have many jets (e.g., 6000), and each jet typically operates at 50-150,000 cycles per second, the power dissipation can be significant even though much less power is needed to drive a continuous jet compared to a thermal drop on-demand jet.

Most conventional inkjet heads use a piezoelectric drive, which is essentially capacitive so little power is dissipated. However, piezoelectric drive technology has some drawbacks and disadvantages. For example, piezoelectric drive technology is plagued with non-uniformity and degradation issues related to the piezo material and its bonding to the drop generator diaphragm. Thus, it would be useful to have a capacitive continuous inkjet drive technology that is uniform and does not degrade with time or the number of cycles.

SUMMARY

An embodiment relates generally to a method of ejecting ink. The method includes providing a continuous stream of ink from a pressurized fluid chamber and activating a drive signal to activate a micro-electrostatic mechanical system (MEMS) membrane. The method also includes stably breaking up the jet stream into uniform droplets in response to driving the MEMS membrane to perturb the continuous stream of ink.

Another embodiment pertains generally to an apparatus for ejecting ink. The apparatus includes a fluid chamber configured to hold the ink and a nozzle configured to eject the ink from the fluid chamber in a stream. The apparatus also includes a micro-electro mechanical system (MEMS) membrane placed within the fluid chamber to create two sub-chambers within the fluid chamber, where a first sub-chamber of the sub-chambers is filled with ink and a second sub-chamber is not filled with ink. The apparatus further includes a drive electrode configured to be placed in the second sub-chamber, wherein the drive electrode is configured to drive the MEMS membrane to stably break up the stream into uniform droplets as ink is being continuously ejected from the nozzle to form an ink droplet in response to an activation signal on the drive electrode.

Yet another embodiment relates generally to a printhead. The printhead includes an array of nozzles. Each nozzle of the array of nozzles includes a fluid chamber configured to hold the ink an opening configured to eject the ink from the fluid chamber in a stream. The printhead also includes a micro-electro mechanical system (MEMS) membrane placed within the fluid chamber to create two sub-chambers within the fluid chamber, where a first sub-chamber of the sub-chambers is filled with ink and a second sub-chamber is not filled with ink. The printhead further includes a drive electrode configured to be placed in the second sub-chamber, where the drive electrode is configured to drive the MEMS membrane to stably break up the stream into uniform droplets as ink is being continuously ejected from the nozzle to form an ink droplet in response to an activation signal on the drive electrode.

BRIEF DESCRIPTION OF THE DRAWINGS

Various features of the embodiments can be more fully appreciated, as the same become better understood with reference to the following detailed description of the embodiments when considered in connection with the accompanying figures, in which.

DETAILED DESCRIPTION OF EMBODIMENTS

For simplicity and illustrative purposes, the principles of the present invention are described by referring mainly to exemplary embodiments thereof. However, one of ordinary skill in the art would readily recognize that the same principles are equally applicable to, and can be implemented in, all inkjet printers, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

Embodiments pertain generally to MEMS printheads. More particularly, an electrostatic micro-electro mechanical systems ("MEMS") membrane can be configured to break off ink drops in a printhead in a precise and controlled manner. A printhead can be configured to include a pressurized fluid chamber with an opening. The opening is where ink is ejected from the fluid chamber. The ink is forced out of the fluid chamber by the pressurized fluid chamber in a continuous stream. Within the pressurized fluid chamber, an electrostatic MEMS membrane can be perturbed or activated to flex to form a pressure wave within the fluid chamber, thus causing the stable breakoff of ink droplets from the pressurized jet stream. The electrostatic MEMS membrane can be driven by a drive signal with a frequency in the range from about 50 KHz to about 250 kHz.

The electrostatic MEMS membrane and drive circuits can be fabricated using silicon wafer fabrication techniques. Since electrostatic MEMS membranes are capacitive, these devices dissipate little power unlike conventional continuous ink jet printheads. The lower power requirement has an added benefit of permitting high nozzle densities which can be enabled in the range from about 600 nozzles per inch ("npi") to about 1200 npi.

Figure 1:
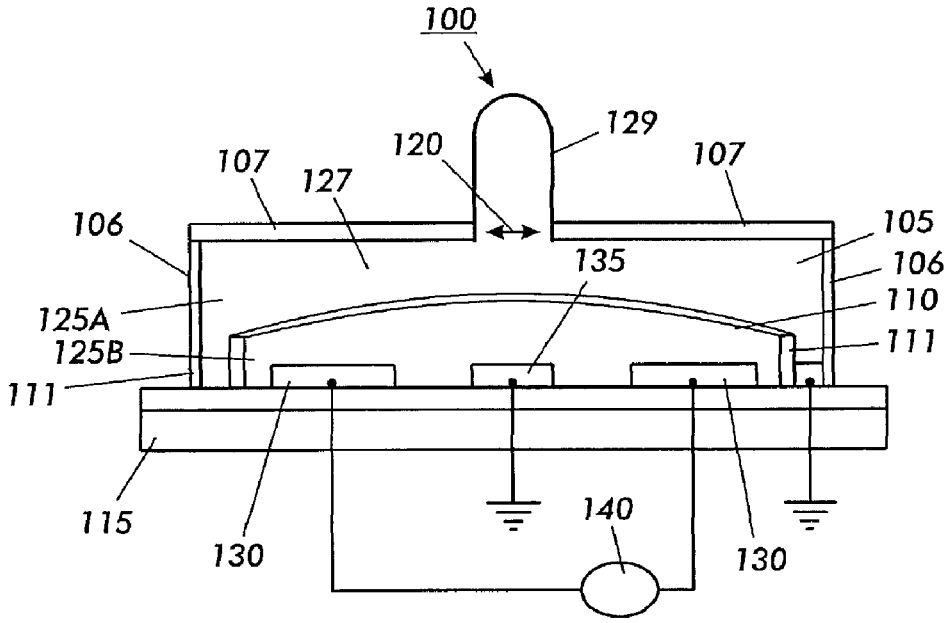
FIG. 1 depicts an exemplary nozzle in accordance with an embodiment.

FIG. 1 illustrates an exemplary MEMS membrane inkjet drop generator 100 in accordance with an embodiment. It should be readily apparent to those of ordinary skill in the art that the system 100 depicted in FIG. 1 represents a generalized schematic illustration and that other components may be added or existing components may be removed or modified.

As shown in FIG. 1, the drop generator 100 includes a fluid chamber 105 and a MEMS membrane 110. The fluid chamber 105 can be configured to be a three dimensional chamber formed over a substrate 115. Walls 106 and enclosing member 107 form an enclosed space. In some embodiments, the dimension of the fluid chamber 105 can be 50 μm wide by 500 μm long. Other dimensions can be implemented without departing from the scope and spirit of the claimed invention. The fluid chamber 105 can be implemented with materials such as silicon, polyimide or other similar materials known to those skilled in the art. The fluid chamber 105 can also be configured with an opening (or orifice, nozzle, etc.) 120 through the enclosing member 107. The diameter of the opening 120 can range from about 10 μm to about 100 μm in some embodiments. Other embodiments can have smaller openings 120 or larger openings 120 depending on the application of the inkjet nozzle 100.

The MEMS membrane 110 can be formed within the fluid chamber 105. The MEMS membrane 110 is conductive so that it is grounded while a voltage can be applied to the drive electrode below it. The MEMS membrane 110 can be supported by membrane walls 111. The MEMS membrane 110 can form two sub-chambers 125A, 125B within the space of the fluid chamber 105. The sub-chamber 125A can be filled with ink 127, which is pressurized. An ink inlet (not shown) can be integrated with the walls 106 or enclosing member 107. The pressurization of sub-chamber 125A can force the ink 127 through the opening 120 in a continuous flow or stream 129.

The second sub-chamber 125B can include electrodes 130 and ground electrode 135. The electrodes 130 can be configured to interface with a drive circuit 140 which is known to those skilled in the art. The ground electrode 135 can be tied to a ground signal. The drive circuit 140 can drive the electrodes 130 at a frequency from about 50 kHz to about 250 kHz depending on the requirements of the desired printhead. The second sub-chamber 125B can be filled with air or another compressible gas. Alternatively, the second sub-chamber 125B can be a vacuum. The selected filler gas or lack of gas has the property that it does not significantly impede the deflection of the MEMS membrane 110.

The MEMS membrane 110 and drive circuit 140 can be integrated and implemented using silicon wafer fabrication techniques as known to those skilled in the art as well as the fluid chamber 105. The silicon fabrication techniques offer a mechanism to uniformly produce inkjet drop ejectors without the current problems associated with piezoelectric drive technology.

Figure 2:
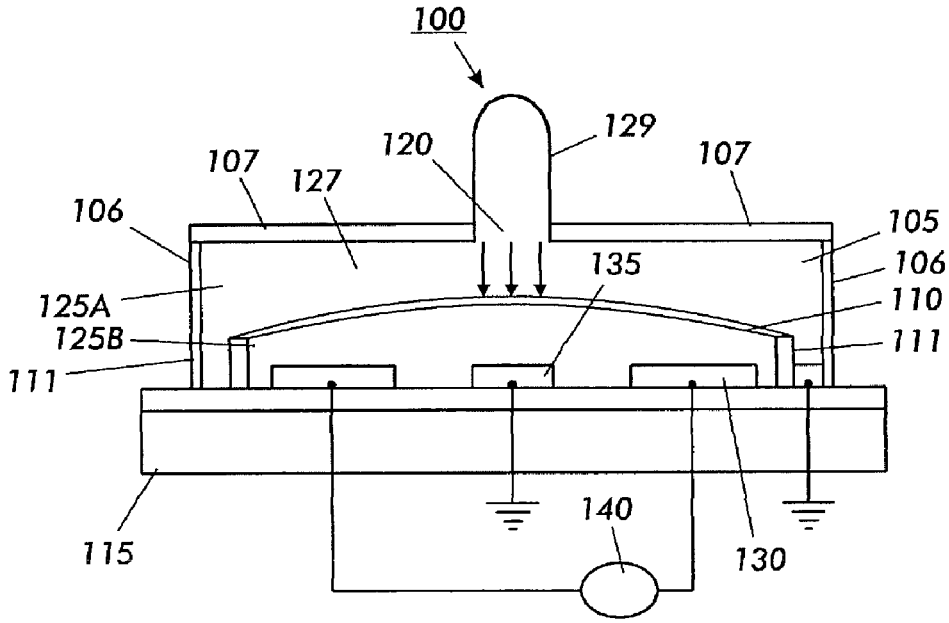
FIG. 2 depicts an exemplary nozzle in an activated position in accordance with an embodiment.

As shown in FIG. 1, the position of the MEMS membrane 110 is in un-activated position. That is, no voltage has been applied to the electrodes 130 from the drive circuit 140. FIG. 2 illustrates the MEMS membrane 110 in an activated position.

FIG. 2 illustrates the membrane 110 in the activated position in accordance with another embodiment. Since FIG. 1 and FIG. 2 share common features, the description of the common features in FIG. 2 are omitted and the descriptions of these features with the FIG. 1 are being relied upon to provide adequate description of the common features.

As shown in FIG. 2, a drive signal, e.g., a voltage signal, can be generated by the drive circuit 140. Since the grounded MEMS membrane 110 forms a capacitor with the electrodes 130, the generated electric field electrostatically attracts the grounded MEMS membrane 110 to the energized drive electrode. That is, the MEMS membrane 110 has deflected. When the drive signal cycles off, the electric field collapses, releasing the MEMS membrane 110 which returns to the unactivated position as shown in FIG. 3 due to the stored spring energy in the membrane 110 during pulldown.

Figure 3:
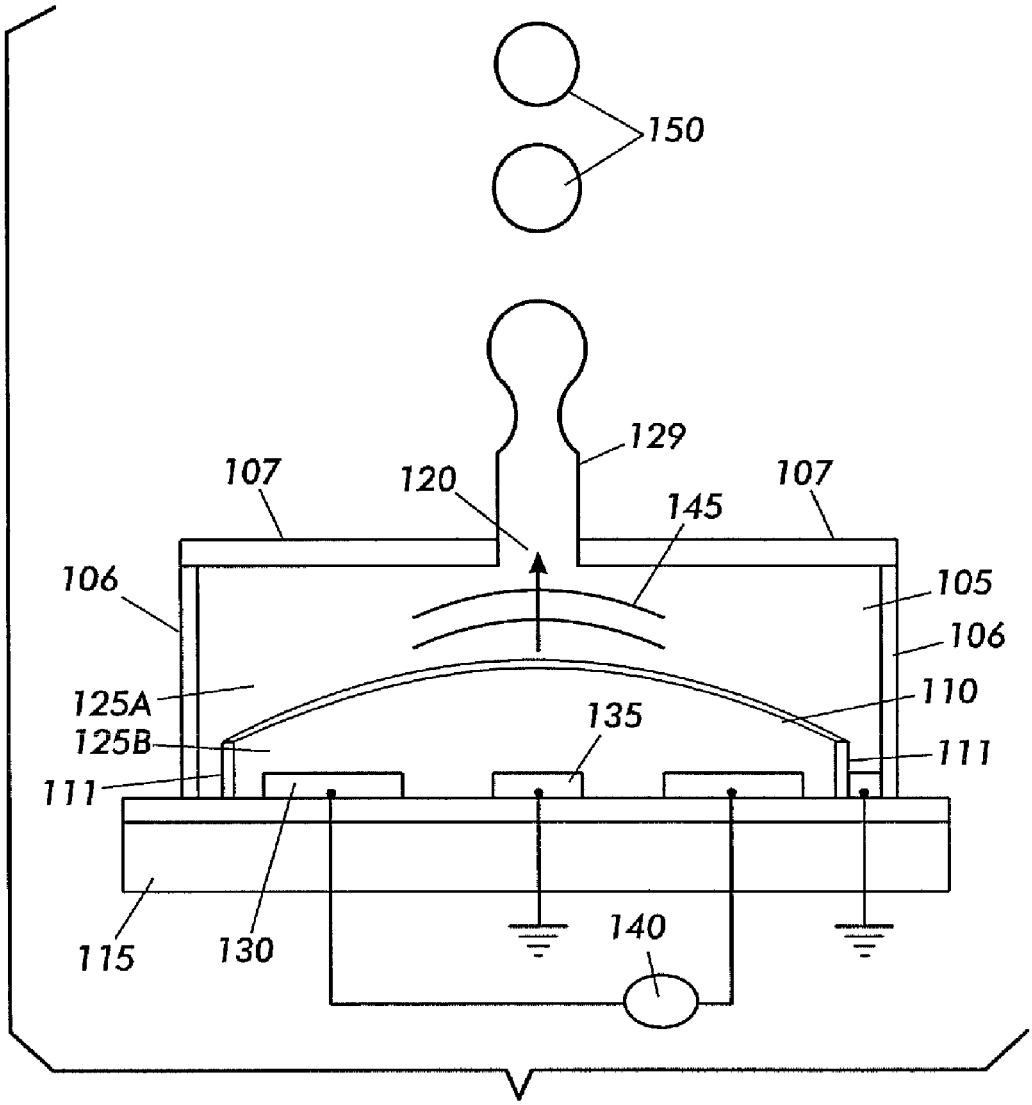
FIG. 3 depicts an exemplary nozzle returning to an unactivated position in accordance with yet another embodiment.

FIG. 3 illustrates the membrane 110 in returning to the un-activated position in accordance with another embodiment. Since FIGS. 1 and 3 share common features, the description of the common features in FIG. 3 are omitted and the descriptions of these features with the FIG. 1 are being relied upon to provide adequate description of the common features.

As shown in FIG. 3, the attraction and release of the MEMS membrane 110 from the drive electrode generates a pressure wave 145 in the fluid contained in the sub-chamber 125A similar to the way a struck drum skin creates sound pressure waves. The pressure wave 145 propagates down the ejecting stream of fluid 129, ultimately causing the jet of fluid to stably and repeatably break up into fluid droplets 150. The fluid droplets 150 are charged during the breakoff process and are then electrostatically deflected to a printable medium or to a gutter.

Fluid such as ink is ejecting in a stream from the opening 120 because of the pressurization of the fluid chamber 105. A stream of fluid naturally breaks up for reasons of surface energy of the drops. An un-driven stream of fluid breaks up fairly randomly due to small random variations, resulting in many different drop sizes and breakoff lengths. If a signal is applied, e.g., a pressure wave, to the stream of fluid that is larger than the random variation, the applied signal dominates the random noise and drop breakoff always occurs at the same place with the non-variable drop volume. Accordingly, embodiments of the present invention provide an architecture and method of easily applying a drive signal to the stream of fluid by moving a membrane.

Furthermore, embodiments of the present invention utilize much less force and have lower power requirements due to the capacitive nature of the MEMS membrane. Accordingly, the density of inkjet densities can be increased from conventional 200 nozzles per inch to 600 or 1200 nozzles per inch Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the invention has been described with reference to the exemplary embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Those skilled in the art will recognize that these and other variations are possible within the spirit and scope as defined in the following claims and their equivalents.

What is claimed is:

1. A method of ejecting ink, the method comprising:

providing a continuous stream of ink from a pressurized fluid chamber;

activating a drive signal to activate a micro-electrostatic mechanical system (MEMS) membrane; and generating a pressure wave down the continuous stream of ink, the pressure wave being larger than a random variation in fluid break-up of the stream, thereby stably breaking up the jet stream into uniform droplets in response to perturbing the MEMS membrane to perturb the continuous stream of ink.

2. The method of claim 1, further comprising pressurizing ink to form the continuous stream of ink.

3. The method of claim 1, wherein the MEMS membrane is an electrostatic membrane.

4. The method of claim 1, wherein the MEMS membrane is fabricated using silicon wafer fabrication techniques.

5. The method of claim 1, wherein the MEMS membrane is capacitive.

6. An apparatus for ejecting ink, the apparatus comprising:

a fluid chamber configured to hold the ink;

a nozzle configured to eject the ink from the fluid chamber in a stream;

a micro-electro mechanical system (MEMS) membrane placed within the fluid chamber to create two sub-chambers within the fluid chamber, a first sub-chamber of the sub-chambers filled with ink and a second sub-chamber not filled with ink; and a drive electrode configured to be placed in the second sub-chamber, wherein the drive electrode is configured to drive the MEMS membrane at a deflection to generate a pressure wave down the continuous stream of ink which is larger than a random variation in fluid break-up of the stream, to stably break up the stream into uniform droplets as ink is being continuously ejected from the nozzle to form an ink droplet in response to an activation signal on the drive circuit.

7. The apparatus of claim 6, wherein the fluid chamber is pressurized to continuously eject ink through the nozzle.

8. The apparatus of claim 6, wherein the MEMS membrane is an electrostatic membrane.

9. The apparatus of claim 6, wherein the MEMS membrane is fabricated using silicon wafer fabrication techniques.

10. The apparatus of claim 6, wherein the MEMS membrane is capacitive.

11. A printhead, comprising:

an array of nozzles, each nozzle of the array of nozzles further comprises:

a fluid chamber configured to hold the ink;

an opening configured to eject the ink from the fluid chamber in a stream;

a micro-electro mechanical system (MEMS) membrane placed within the fluid chamber to create two sub-chambers within the fluid chamber, a first sub-chamber of the sub-chambers filled with ink and a second sub-chamber not filled with ink; and a drive electrode configured to be placed in the second sub-chamber, wherein the drive electrode is configured to drive the MEMS membrane at a deflection to generate a pressure wave down the continuous stream of ink which is larger than a random variation in fluid break-up of the stream, to stably break up the stream into uniform droplets as ink is being continuously ejected from the nozzle to form an ink droplet in response to an activation signal on the drive circuit.

12. The printhead of claim 11, wherein the fluid chamber is pressurized to continuously eject ink through the opening.

13. The printhead of claim 11, wherein the MEMS membrane is electrostatic membrane.

14. The printhead of claim 11, wherein the MEMS membrane is fabricated using silicon wafer fabrication techniques.

15. The printhead of claim 11, wherein the array of nozzles has a density in the range from about 600 100 nozzles per inch to about 1200 nozzles per inch.

* * * * *